United States Patent [19]

Schemitsch

[11] Patent Number: 5,033,392

[45] Date of Patent: Jul. 23, 1991

[54] APPARATUS FOR LOADING AND UNLOADING PASSENGERS FROM WATERCRAFT

[75] Inventor: Walter Schemitsch, Neuseiersberg, Austria

[73] Assignee: Waagner-Biro Aktiengesellschaft, Austria

[21] Appl. No.: 496,805

[22] Filed: Mar. 21, 1990

[30] Foreign Application Priority Data

Mar. 21, 1989 [AT] Austria ..... 654/89

[51] Int. Cl.[5] ..... A63G 3/02

[52] U.S. Cl. ..... 104/35; 104/28; 104/30; 104/73

[58] Field of Search ..... 104/28, 30, 31, 23.1, 104/23.2, 35, 53, 59, 69, 70, 71, 72, 73, 99, 21; 272/32; 198/324, 321

[56] References Cited

U.S. PATENT DOCUMENTS

| | | | |
|---|---|---|---|
| 904,848 | 11/1908 | Devore | 104/53 |
| 1,379,185 | 5/1921 | Healy | 104/59 |
| 1,689,138 | 10/1928 | Hire | 272/32 |
| 3,727,558 | 4/1973 | Winkle | 104/28 |
| 3,865,041 | 2/1975 | Bacon | 104/73 |
| 4,543,886 | 10/1985 | Spieldiener et al. | 104/73 |

FOREIGN PATENT DOCUMENTS

| | | |
|---|---|---|
| 64577 | 4/1913 | Austria . |
| 137780 | 3/1983 | European Pat. Off. . |
| 917176 | 7/1949 | Fed. Rep. of Germany . |
| 1703811 | 3/1972 | Fed. Rep. of Germany . |

*Primary Examiner*—Robert J. Oberleitner
*Assistant Examiner*—Mark T. Le
*Attorney, Agent, or Firm*—Steinberg & Raskin

[57] ABSTRACT

Apparatus for loading and unloading passengers from watercraft, such as for use in boat rides at amusement parks, include a substantially planar inclined platform mounted for rotation about an axis perpendicular to the plane of the platform. The platform extends obliquely to the path of the watercraft so that a section of the platform is submerged. Watercraft traveling along a predetermined path are engaged by a section of the rotating platform as it surfaces and is carried by the platform over an arcuate path as it rotates. The watercraft is disengaged from the rotating platform as the section of the platform on which it rests submerges.

12 Claims, 1 Drawing Sheet

APPARATUS FOR LOADING AND UNLOADING PASSENGERS FROM WATERCRAFT

BACKGROUND OF THE INVENTION

This invention generally relates to apparatus for loading and unloading passengers from watercraft, and more particularly, to apparatus for loading and unloading passengers from watercraft which move along a predetermined path, such as in connection with boat rides in amusement parks. Specifically, the invention relates to apparatus of this type which include a rotary platform from which passengers can safely embark onto watercraft, and onto which passengers can safely disembark from watercraft, as the platform rotates.

Loading platforms for watercraft rides at amusement parks are known which include rotating disc-shaped platforms from which passengers can embark onto a more or less floating boat, or onto which a passenger can disembark from a boat. For example, an arrangement is disclosed in European patent application EP 137780 published Apr. 24, 1985 in which the amusement ride loading terminal comprises a revolving circular platform with the periphery of which watercraft become engaged for loading and unloading passengers. A drawback of such conventional arrangements is that the level of the floor of the boat is generally substantially lower than the surface of the rotating platform, and this, together with the fact that the passenger must generally step over a water gap between the periphery of the rotating platform and the boat, often acts as psychological, as well as physical, impediment to the rapid and efficient transfer of passengers to and from the watercraft.

SUMMARY OF THE INVENTION

It is an object of the present invention to provide new and improved apparatus for loading and unloading passengers from watercraft traveling along a predetemined path, such as in boat rides at amusement parks.

A more specific object of the present invention is to provide new and improved apparatus of the rotating-platform type for loading and unloading passengers from watercraft moving along a predetermined path which do not have the drawbacks of conventional arrangements of this type.

Briefly, these and other objects are attained by providing a rotary platform situated in the path of the watercraft wherein the plane of the platform extends obliquely to the path along which the watercraft travels. As the watercraft travels along its path, it is engaged by a section of the rotating platform as the platform section surfaces or emerges from a submerged position, and then is carried by the platform as it rotates until the platform section on which the watercraft is carried submerges whereupon the watercraft is disengaged therefrom. In other words, the watercraft is engaged and lifted out of the water by a section of the platform as it surfaces during rotation of the platform and rests on the rotating platform until it is returned to the water when the section of the platform on which it rests again submerges. The surface of the rotating platform is preferably covered with a high-friction, liquid-permeable material.

The watercraft may be coupled to a guide track or the like as it travels through the water whereupon the craft is uncoupled from the guide track as it is lifted from the water on an emerging section of the platform, and recoupled to the guide track at a point where the craft disengages from the submerging platform section. Although the watercraft generally comprises floatable boats, they may also comprise gliding sleds or boards which generally are adapted to travel faster, thereby increasing the need for more efficient and rapid passenger transfers.

The apparatus may also include means for guiding passenger traffic between the rotary platform and a stationary surrounding region proximate to the platform. According to the invention, such means may comprise, for example, a bridge having one end situated proximate to the center of rotation of the rotary platform that does not move at a substantial velocity. Moreover, the rotary speed of the watercraft as it is carried along on the rotating platform is less than the speed of the watercraft as it travels through the water along the predetermined path, such that the linear density of watercraft on the platform is greater than the linear density of the watercraft as it travels over the water, thereby further facilitating passenger loading and unloading.

DESCRIPTION OF THE DRAWINGS

A more complete appreciation of the present invention, and many of the attendant advantages thereof will be readily understood by reference to the following detailed description when considered in connection with the accompanying drawings in which.

DESCRIPTION OF THE PREFERRED EMBODIMENTS

Figure 1:
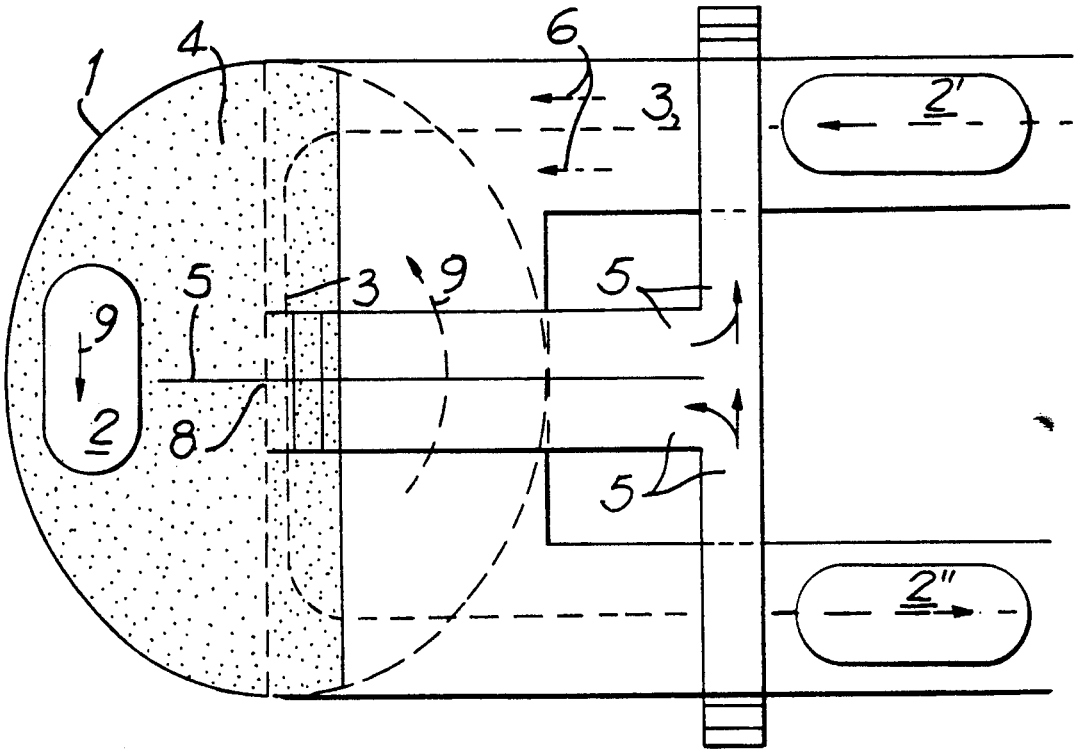
FIG. 1 is a schematic plan view of apparatus in accordance with the invention.

Referring now to the drawings wherein like reference characters designate identical or corresponding parts throughout the several views, a terminal area according to the invention is illustrated of an amusement park boat ride at which watercraft, designated 2', travel over an incoming leg of a predetermined path to the loading-unloading platform 1 on which passengers disembark from, and new passengers are loaded onto, the watercraft, now designated 2. The newly-loaded watercraft, now designated 2'', continues its travel over an outgoing leg of the predetermined path. The watercraft is coupled to a driver track 3 on the incoming and outgoing legs.

Figure 2:
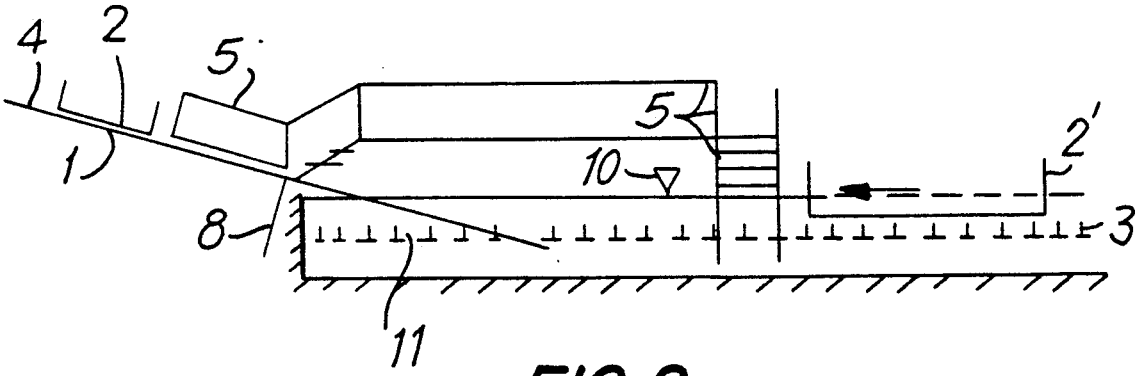
FIG. 2 is a schematic side elevation view of the apparatus illustrated in FIG. 1.

The loading platform 1 is substantially planar and in the illustrated embodiment is disc-shaped. The platform 1 is mounted for rotation about a central axis 8 that is substantially perpendicular to the plane of the platform 1. As best seen in FIG. 2, the platform is inclined, i.e. the plane of platform 1 extends obliquely to the path over which the watercraft travels, so that a portion of the platform is always submerged beneath the surface of water 10. The incoming watercraft 2' moving in the direction designated by arrows 6, becomes situated over the submerged section of the rotating inclined platform 1 whereupon the watercraft is engaged by a section of the platform as it emerges from the water, whereupon it is uncoupled from track 3 and begins to be carried on the surface of the rotating platform. A section of the rotary platform 1 thus engages a watercraft at a point of engagement and lifts it from the water as the platform section itself emerges from the water. The watercraft 2 is then carried on platform 1 in an arcuate path in the direction of arrow 9 about 180 degrees whereupon the platform section carrying the watercraft begins to submerge. The watercraft disengages from the platform as it submerges, is re-coupled to the drive track, and then continues on the outgoing leg of its predetermined path.

It is seen from the foregoing that the invention essentially comprises an inclined rotary platform 1 which is partially immersed in a body of liquid. The platform is adapted to engage and lift watercraft from the water, carry the watercraft on its surface to enable passenger loading and/or unloading, and then deposit the boat back into the water.

Passengers enter onto and leave from the rotary platform by means of a pathway communicating between a substantially central region of the platform 1 proximate to its axis of rotation 8. Thus, passengers may enter onto and leave from platform 1 by means of a bridge structure 5 having ends situated at stationary areas in the vicinity of platform 1, and an end situated at the central region of rotating platform 1 in the region of the axis of rotation 8 so that it does not move at any substantial velocity. The bridge 5 may have a center handrail or divider defining incoming and outgoing passenger routes designated by arrows 7. The center region of the disc-shaped platform 1 can also be in the form of a stationary island, in which case the revolving platform 1 per se has an annular configuration so that it is possible for passengers to step from the bridge 5 onto a stationary surface.

The rotary platform 1 is provided with a finely porous covering 4, preferably an adhesive covering that is permeable to liquid, so that on the one hand, the watercraft 2 will not slip on the surface of the platform, while on the other hand, the passengers have a sure footing even in unfavorable weather conditions, such as where the platform becomes moist from rain or the like.

It is seen from the figures that watercraft 2 are moved by the track 3 which travels underneath the bridge structure 5 and platform 1. The watercraft is pulled through an incoming channel at a predetermined speed onto the surface of the platform at a point of engagement, whereupon the watercraft 2 is carried by platform 1 in the direction of arrow 9 over an arcuate path to a point of disengagement in a separate outgoing channel. The track 3 has a portion 11 that is guided beneath the revolving platform 1.

It will be understood that the guide track 3 shown in the illustrated embodiment may be replaced by other means for moving the watercraft, e.g., by a water current flow through a narrow trench. Such an arrangement would be desireable in the case where watercraft are launched into the water by an appropriate velocity guide, for example, by means of skid slopes.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for loading and unloading passengers from watercraft moveable along a predetermined path in a body of water, comprising:

means for guiding watercraft in a predetermined path through a body of water;

a substantially planar platform mounted along said predetermined path for rotation about an axis substantially perpendicular to he plane of said platform and with said plane of said platform extending obliquely to said predetermined path of aid watercraft such that a portion of said platform is submerged in said body of water; and means for rotating said platform;

whereby a watercraft traveling along said predetermined path is engaged by a section of said rotation platform as aid rotating platform surfaces from a submerged position, is carried by said platform as the platform rotates, and is disengaged from the section of said rotating platform at a point of disengagement as the platform section submerges.

2. Apparatus as recited in claim 1 wherein said platform is substantially disc-shaped, and wherein said axis of rotation passes through a central region of said disc-shaped platfrom.

3. Apparatus as recited in claim 1 wherein said platform is formed of a liquid-permeable material.

4. Apparatus as recited in claim 1 wherein said platform includes a fine porous covering material permeable to liquid.

5. Apparatus as recited in claim 4 wherein said covering material is a high-friction material.

6. Apparatus as recited in claim 1 wherein said means for guiding watercraft in a predetermined path comprises track means to which said watercraft is coupled as it moves along a predetermined path, said watercraft becoming uncoupled from said track means substantially at said point of engagement of said watercraft by said platform, and said watercraft becoming re-coupled to said track means substantially at said point of disengagement from said platform.

7. Apparatus as recited in claim 1 wherein said watercraft comprises floatable boats.

8. Apparatus as recited in claim 1 further including traffic guidance means communicating between said platform and a stationary surrounding area for facilitating passenger entry onto and exit from said platform from and to said surrounding area.

9. Apparatus as recited in claim 8 wherein said traffic guidance means define a path over which passengers move between said stationary area and a central region of said platform proximate to said axis of rotation thereof.

10. Apparatus as recited in claim 9 wherein said traffic guidance means comprise a bridge structure extending between said surrounding area and a central region of said platform proximate to said axis of rotation thereof.

11. Apparatus as recited in claim 1 wherein said watercraft travels on said rotating platform from said point of engagement therewith to said point of disengagement therefrom over an arcuate path at an angular speed determined by the rate at which said platform rotates, and wherein said angular speed of said watercraft over said arcuate path on said rotating platform is greater than the speed of said watercraft along said predetermined path.

12. Apparatus as recited in claim 11 wherein the density of watercraft traveling on said rotating platform is greater than the density of watercraft along said predetermined path.

* * * * *